US008978423B2

(12) United States Patent
Kim

(10) Patent No.: US 8,978,423 B2
(45) Date of Patent: Mar. 17, 2015

(54) CONTROL METHOD OF A LAUNDRY TREATMENT MACHINE

(75) Inventor: Youngjong Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1003 days.

(21) Appl. No.: 12/841,767

(22) Filed: Jul. 22, 2010

(65) Prior Publication Data

US 2011/0016639 A1 Jan. 27, 2011

(30) Foreign Application Priority Data

Jul. 23, 2009 (KR) ..... 10-2009-0067376

(51) Int. Cl.

| | |
|---|---|
| ***B08B 3/12*** | (2006.01) |
| ***D06F 37/00*** | (2006.01) |
| ***D06F 35/00*** | (2006.01) |
| ***D06F 39/08*** | (2006.01) |

(52) U.S. Cl.

CPC ..... *D06F 35/005* (2013.01); *D06F 39/088* (2013.01); *D06F 2204/065* (2013.01); *D06F 2204/086* (2013.01)

USPC ..... 68/3 R

(58) Field of Classification Search

None

See application file for complete search history.

(56) References Cited

U.S. PATENT DOCUMENTS

| | | | | |
|---|---|---|---|---|
| 5,737,790 | A * | 4/1998 | Badger et al. | 8/158 |
| 2004/0010860 | A1* | 1/2004 | Johanski et al. | 8/158 |
| 2008/0256722 | A1* | 10/2008 | Oberkirsch et al. | 8/159 |
| 2009/0139278 | A1* | 6/2009 | Kim et al. | 68/5 C |

* cited by examiner

*Primary Examiner* — Jason Ko

(74) *Attorney, Agent, or Firm* — Birch, Stewart, Kolasch & Birch, LLP

(57) ABSTRACT

Control method of a laundry treatment machine according to the present invention comprises a spray rinse step that water is sprayed a little at a time several times, and a spin rinse step that the water is not sprayed and an inner tub is rapidly rotated for water penetration.

Thus, by performing the spin rinse step which is not to spray total water at once but to spray a little water at a time and the inner tub is rapidly rotated while the water is sprayed, fabrics can be effectively soaked and the water penetration can be improved, and thus rinsing performances can be improved.

Also, a motor is rotated at low speed while water is sprayed, so that it can be prevented that water sprayed spattered. Also, the water spray is temporarily stopped and the inner tub is rotated at high speed during the spin rinse step, and thus an effect of water penetration can be improved by centrifugal force.

7 Claims, 7 Drawing Sheets

CONTROL METHOD OF A LAUNDRY TREATMENT MACHINE

This application claims priority from Korean Patent Application No. 10-2009-0067376 filed on Jul. 23, 2009, in the Korean Intellectual Property Office, the disclosure of which is incorporated herein by reference in its entirety.

BACKGROUND OF THE INVENTION

1. Field of the Invention

The present invention relates to control method of a laundry treatment machine, and more particularly, to control method of a laundry treatment machine that fabric can be evenly soaked by spraying water through a spray nozzle.

2. Description of the Conventional Art

In general, fabric treating machine include a washing machine for removing contaminants stuck to clothes, beddings and the like (hereinafter, referred to as "fabric") by using water, detergent and a mechanical action, a drying machine for drying wet fabric using dried hot air heated by a heater and a mechanical action, and a washing/drying machine having both a washing function and a drying function.

The washing machine can be classified into a top load type washing machine that has a fabric entrance formed at the top of a cabinet thereof and washes fabric according to revolving water flow generated when an inner tub is rotated and a drum type washing machine that has a fabric entrance formed at the front side of a cabinet thereof and washes fabric according to fabric fall occurring when a drum is rotated.

A conventional top load type washing machine includes a cabinet that forms the external appearance of the washing machine and has an opened top face, a top cover that is combined with the opened top face of the cabinet and has a fabric entrance formed therein, a door mounted to rotate on the fabric entrance, a base disposed at the bottom of the cabinet, an outer tub disposed in the cabinet for containing water therein, an inner tub located in the outer tub for washing fabric, a motor unit located under the inner tub to rotate the inner tub, a water supply unit for supplying water into the outer tub, and a drain unit for draining water from the outer tub. Furthermore, the washing machine includes a detergent supply unit connected to the water supply unit to supply detergent with water.

The washing machine further includes a pulsator for generating a water flow. The pulsator may be formed or installed at the bottom face of the inner tub.

In the conventional washing machine, the inner tub and the pulsator are rotated to the same direction or the different direction, and thus a washing step, a rinse step and a dehydration step may be performed.

However, in the conventional top load type washing machine, the water supply unit and the detergent supply unit are disposed at one side of the top of the cabinet, and thus washing water and the detergent are supplied to only one side of the inner tub. Accordingly, fabric is not evenly soaked. In this case, washing and rinsing performances are deteriorated.

Recently, water is sprayed by a spray nozzle for soaking the fabric evenly. But, in case of water spray, there is a problem that an effect of water penetration is decreased.

SUMMARY OF THE INVENTION

It is an object of the present invention to provide control method of a laundry treating machine that water consumption can decrease and fabric can be evenly soaked and an effect of water penetration and rinsing performance can be improved.

To accomplish the object of the present invention, there is provided control method of a laundry machine comprising a spray rinse step that a portion of water which is predetermined to be used all for the rinse step is sprayed by a spray nozzle and a inner tub is rotated; and a spin rinse step that the water supply through the spray nozzle is shut off and the inner tub is rotated; wherein the spray rinse step and the spin rinse step is repeated in order for the predetermined number of times.

In the present invention, a drain pump is always operated for the spray rinse step and the spin rinse step.

In the present invention, the spray rinse step further includes that the inner tub is rotated with the predetermined constant rotating speed.

In the present invention, the spin rinse step further includes that a motor is rotated and accelerated for the predetermined time.

In the present invention, the spray rinse step is repeated several times for the rinse step, the amount of the water which is sprayed for the each spray rinse step is set by being divided the total amount of water used for the rinse step by the performing number of the spray rinse step equally.

In the present invention, the performing time of the spin rinse step is set longer than the performing time of the spray rinse step.

In the present invention, the spin rinse step comprises a constant spin rinse step that the inner tub is rotated with the predetermined constant speed for the predetermined time; and an accelerated spin rinse step that the inner tub is accelerated for the predetermined time.

In the present invention, the constant spin rinse step and the accelerated spin rinse step are alternatively performed after the spray rinse step.

In the present invention, a cycle is comprised that the spray rinse step, the constant spin rinse step, the spray rinse step and the accelerated spin rinse step are once performed in order, and the cycle is repeated several times.

In the present invention, the spray rinse step includes that the inner tub is rotated with a first rotating speed which is predetermined.

In the present invention, the constant spin rinse step includes that the inner tub is rotated with a second rotating speed which is faster than the first rotating speed for the predetermined time.

In the present invention, the accelerated spin rinse step includes that the inner tub is rotated with the accelerated speed from the first rotating speed for the predetermined time.

In the present invention, the accelerated spin rinse step includes that the inner tub is accelerated at a high speed which is faster than the second rotating speed for the predetermined time.

In the present invention, the process time of the constant spin rinse step is set shorter than the process time of the accelerated spin rinse step.

In the present invention, the drain pump is always operated in the spray rinse step, the constant spin rinse step and the accelerated spin rinse step.

In the present invention, the amount of the water which is sprayed for the each spray rinse step is set by being divided the total amount of water used for the rinse step by the performing number of the spray rinse step equally.

In another aspect of the present invention, there is provided Control method of a laundry machine comprising a first spray rinse step that water is sprayed by a spray nozzle and a inner tub is rotated with a first rotating speed for the predetermined time; and a constant spin rinse step, which is performed after the first spray rinse step is finished, that the water supply through the spray nozzle is shut off and the inner tub is accelerated to a second rotating speed which is faster than the first rotating speed for the first set time and then is rotated with maintaining the second rotating speed; and a second spray rinse step, which is performed after the constant spin spray rinse step is finished, that the water is sprayed by the spray nozzle and the inner tub is rotated with the first rotating speed for the predetermined time; and an accelerated spin rinse step, which is performed after the second spray rinse step is finished, that the water supply through the spray nozzle is shut off and the inner tub is accelerated from the first second rotating speed for a second set time which is longer than the first set time; wherein a cycle is comprised of the first spray rinse step, the constant spin rinse step, the second spray rinse step and the accelerated spin rinse step, and the cycle is repeated for the several times.

In the present invention, the amount of water which is sprayed in the first spray rinse step is equal to the amount of water which is spray in the second spray rinse step.

In the present invention, the accelerated spin rinse step includes that the inner tub is rotated with an accelerated speed which is faster than the second rotating speed for the predetermined time.

In the present invention, the drain pump is always operated for a plurality of the cycles.

Control method of a laundry treatment machine according to the present invention is to perform a spin rinse step between spray rinse steps and not to spray total water at once but to spray a little water at a time. Therefore, fabric can be effectively soaked and the water penetration can be improved, and thus rinsing performances can be improved.

Also, because the spray rinse step comprises that the inner tub is rotated at low speed, it can be prevented that water sprayed through the spray nozzle spattered.

Also, because the spin rinse step comprises that the water spray is temporarily stopped and the inner tub is rotated at high speed, it can be prevented that water spattered, and an effect of water penetration can be improved by centrifugal force.

Also, a cycle is comprised of the spray rinse step and the spin rinse step. A rinsing performance can be improved by repeating the cycle several times.

Also, control method of a laundry treating machine according to the present invention includes the spin rinse step that comprises a constant spin rinse step for rotating the inner tub at high speed constantly and an accelerated spin rinse step for accelerating the inner tub for a time longer than a process time of the constant spin rinse step. The constant spin rinse step and the accelerated spin rinse step are alternatively performed, so that an effect of water penetration can be improved.

Also, control method of a laundry treatment machine according to the present invention comprises a cycle which comprises a first spray rinse step and a constant spin rinse step and a second spray rinse step and an accelerated spin rinse step. The cycle is repeated several times so that an effect of water penetration can be improved.

Also, because a drain pump is always operated in the present invention, the water rinsed fabrics can be instantly discharged. Thus, it can be prevented that fabrics is polluted by water rinsed fabrics.

DETAILED DESCRIPTION OF THE PREFERRED EMBODIMENT

A top load type washing machine (referred to as 'washing machine' hereinafter) will now be explained as an embodiment of a laundry treatment machine according to the present invention with reference to the attached drawings.

Figure 1:
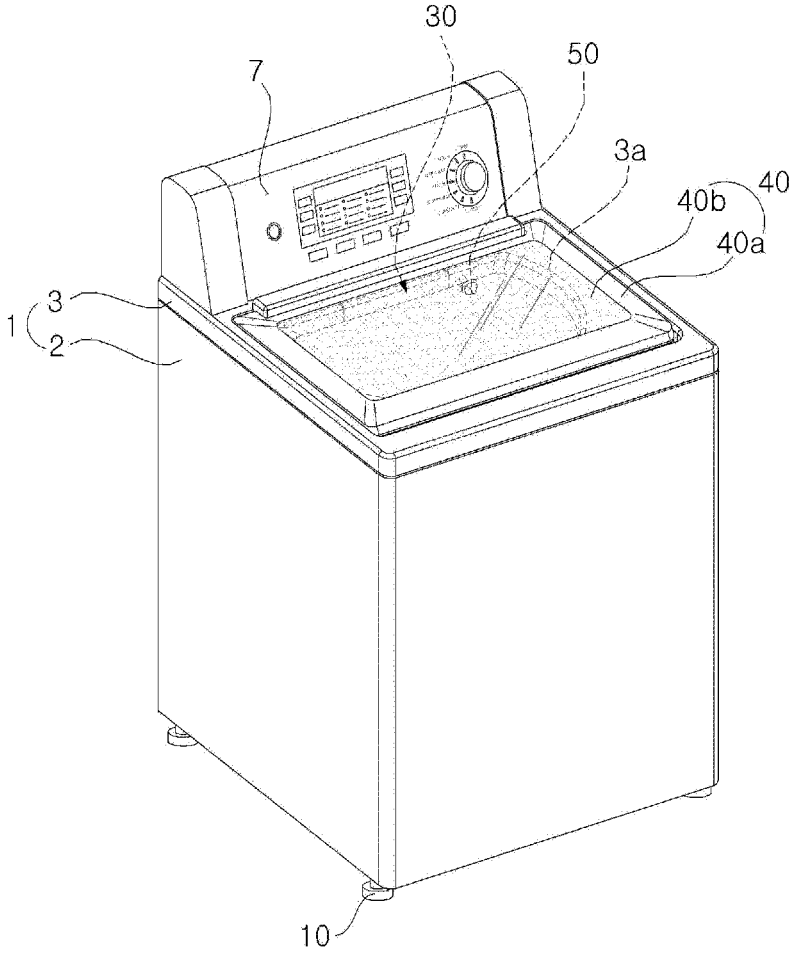
FIG. 1 is a perspective view which illustrates a top load type washing machine according to a first exemplary embodiment of the present invention.
Figure 2:
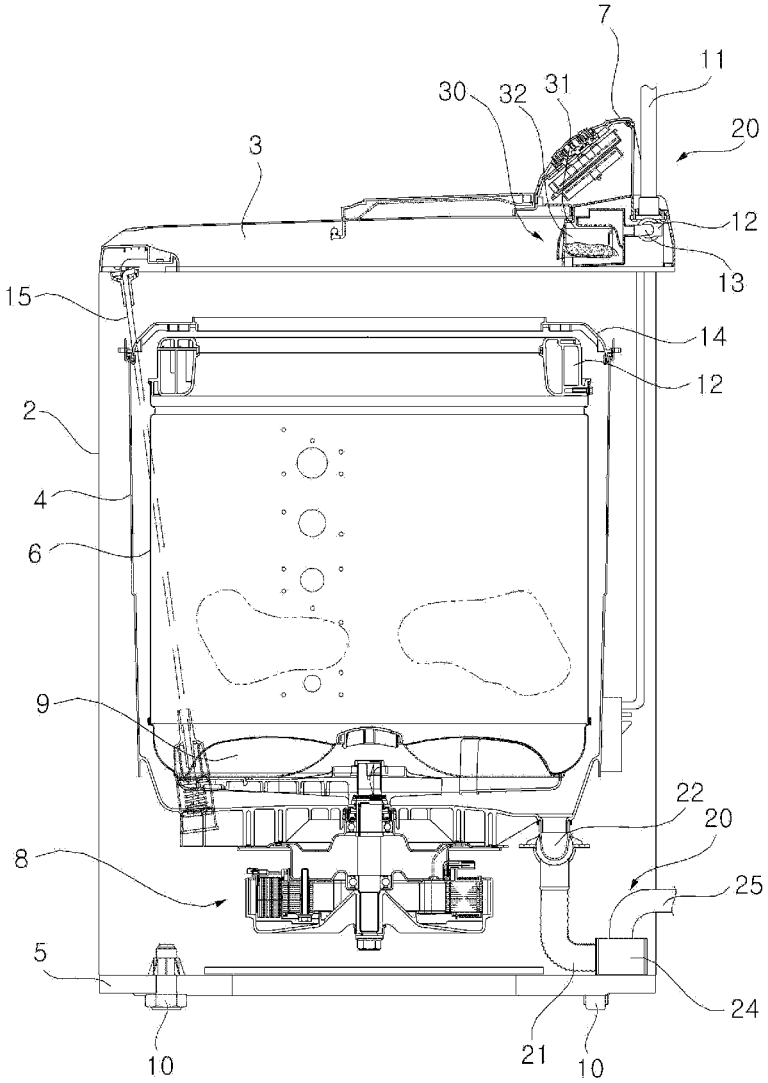
FIG. 2 is a longitudinal section view which illustrates the washing machine shown in FIG. 1.

FIG. 1 is a perspective view which illustrates a top load type washing machine according to a first exemplary embodiment of the present invention. FIG. 2 is a longitudinal section view which illustrates the washing machine shown in FIG. 1.

Referring to FIG. 1 and FIG. 2, a washing machine according a first exemplary embodiment of the present invention comprises a case 1 forming the external appearance of the washing machine and a leg assembly 10 combined with the bottom of the case 1.

The case 1 includes a cabinet 2 that has an opened top face and an opened bottom face and forms the side of the washing machine, a top cover 3 for covering the opened top face of the cabinet 2, and a base 5 located on the opened bottom face of the cabinet 2.

The cabinet 2 includes an outer tub 4 for containing water, an inner tub 6 that is disposed in the outer tub 4 and has fabric loaded therein, a driver such as a motor 8 for driving the inner tub 6, a water supply assembly for supplying water to the inside of the outer tub 4, and a drain assembly 20 for draining the water contained in the outer tub 4 after a washing or spin-drying operation is finished.

In addition, the washing machine further includes a detergent supply unit 30 for temporarily storing detergent, which is disposed on the top cover 3. The detergent supply unit 30 is connected to the water supply assembly and provides the detergent with supplied water to the inner tub 6.

The top cover 3 includes a fabric entrance 3*a* through which fabric is put in or out of the inner tub 6 and a door 40 for opening/closing the fabric entrance 3*a*. The door 40 may be partially made of glass such that the inside of the washing machine is seen. The door 40 includes a frame 40*a* and a glass part 40*b* fitted in the frame 40*a*.

Further, a display panel 7 for inputting an instruction for operating the washing machine or displaying an operating state of the washing machine is attached to one side of the top cover 3.

The outer tub 4 is suspended from the top of the inside of the cabinet 2 by a plurality of suspensions 15. One end of each suspension 15 may be combined with the top of the inside of the cabinet 2 and the other end thereof may be combined with the bottom of the outer tub 4.

A pulsator 9 is disposed on the bottom of the inner tub 6 to generate a rotating stream in water contained in the outer tub 4. The pulsator 9 may be integrated with the inner tub 6 and rotated with the inner tub 6 when the motor rotates. Otherwise, the pulsator 9 may be formed independently of the inner tub 6 and rotated independent of the inner tub 6 when the motor rotates.

A balancer 12 is disposed at an upper portion of the inner tub 6 to prevent the inner tub 6 from losing its balance due to eccentricity of fabric. The balancer 12 includes a liquid balancer filled with a liquid such as salt water.

An outer tub cover 14 for preventing escape of fabric or scattering of water is disposed on the outer tub 4.

The water supply assembly includes an outer hose 11 for guiding water supplied from an external tap to the washing machine, a water supply valve 12 connected to the outer hose 11 to control supply of water, and a water supply hose 13 for connecting the water supply valve 12 and the detergent supply unit 30. A water supply passage is formed by the water supply valve 12 and the water supply hose 13.

The detergent supply unit 30 is disposed on the water supply passage. The detergent supply unit 30 includes a detergent box housing 31 connected with the water supply hose 13, a detergent box 32 detachably set in the detergent box housing 31, and a detergent box cover fixed to the detergent box housing and disposed on the detergent box 32 to spray water.

The detergent box housing 31 is fitted in a detergent box installing part formed at one side of the top cover 3.

The detergent box 32 is combined with the detergent box housing 31 such that a user can take out the detergent box 32 from the detergent box housing 31 to put detergent into the detergent box. The detergent box 32 may slide into/out of the detergent box housing 31 in the forward/backward direction. At least a part of the backside of the detergent box 32 is opened such that the detergent can be provided to the detergent box housing 31 with water through the backside of the detergent box 32 when the water is supplied.

The drain assembly 20 includes a first drain hose 21 connected to a lower portion of the outer tub 4, a drain valve 22 disposed on the first drain hose 21 to control drainage of water, a drain pump housing 24 having a drain pump for pumping water, and a second drain hose 25 connected to the drain pump housing 24 to drain water pumped by the drain pump to the outside of the cabinet 2. A drain motor for driving the drain pump is disposed inside the drain pump housing 24.

The drain assembly 20 may be disposed between the outer tub 4 and the base 5.

Figure 3:
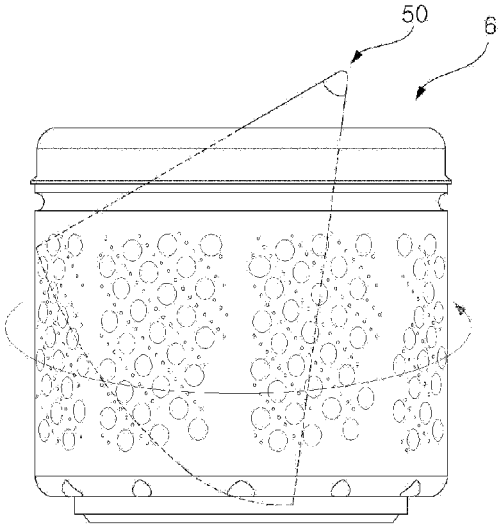
FIG. 3 is a side view showing a spray rinse condition of the washing machine according to the first exemplary embodiment of the present invention.

FIG. 3 is a side view showing a spray rinse condition of the washing machine according to the first exemplary embodiment of the present invention.

Referring to FIG. 1 and FIG. 3, The water supply assembly 10 further includes the spray nozzle 50 for spraying water supplied from the water supply passage to the inside of the inner tub 6. The spray nozzle 50 may be disposed in the top cover 3 or the detergent supply unit 30. In the embodiment of the present invention, it is described that the spray nozzle 50 is disposed in the top cover 3.

Figure 4:
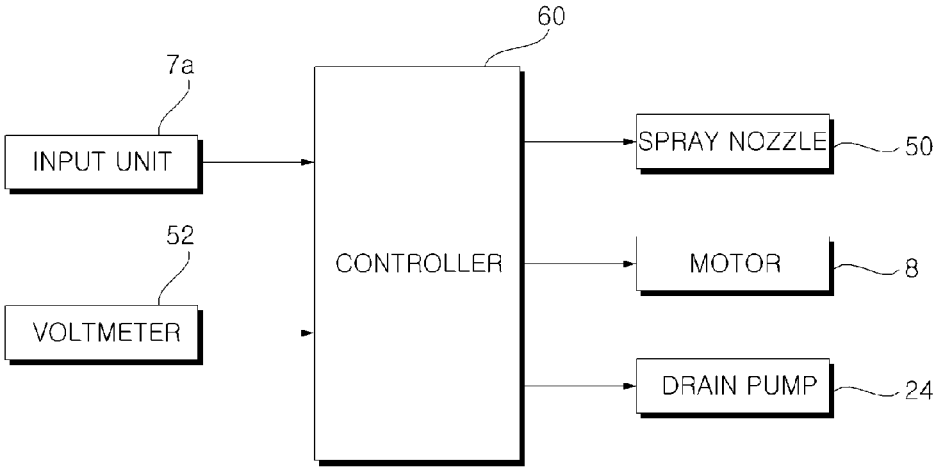
FIG. 4 is a block diagram showing the control flow of the washing machine according to the first exemplary embodiment of the present invention.

FIG. 4 is a block diagram showing the control flow of the washing machine according to the first exemplary embodiment of the present invention.

Referring to FIG. 4, the washing machine comprises an input unit 7*a* disposed on the display panel 7 for inputting an instruction for operating the washing machine, a voltmeter 52 for sensing a change of voltage of the motor 8, a control unit 60 which receives a signal of the input unit 7*a* and the voltmeter 52 and then controls the operation of the spray nozzle 50, the motor 8, and the drain pump 24 according to the signal.

Figure 5:
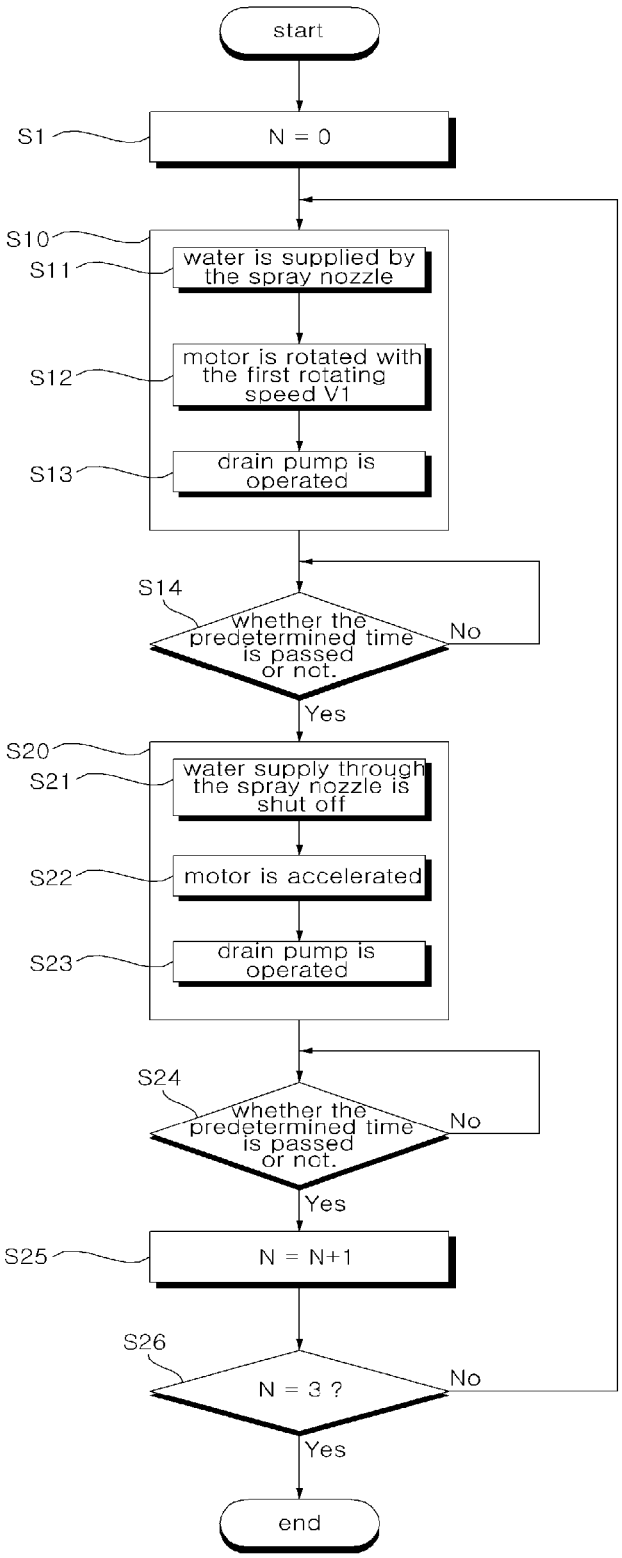
FIG. 5 is a flow chart showing a control method of the washing machine according to the first exemplary embodiment of the present invention.
Figure 6:
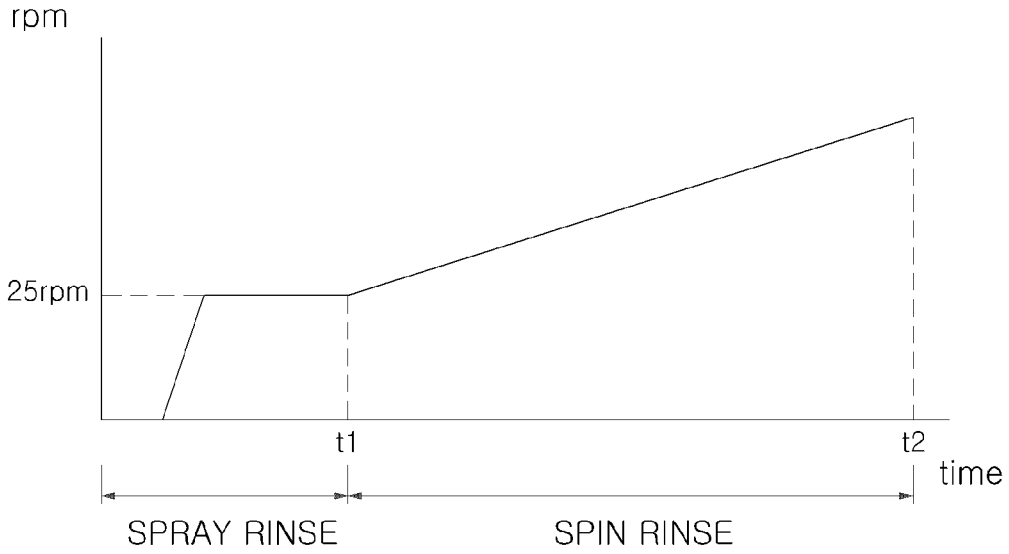
FIG. 6 is a graph showing a rotating speed of an inner tub when a spray rinse step and a spin rinse step is each performed once.

FIG. 5 is a flow chart showing a control method of the washing machine according to the first exemplary embodiment of the present invention. FIG. 6 is a graph showing a rotating speed of an inner tub when a spray rinse step and a spin rinse step is each performed once.

Referring to FIGS. 5 and 6, a control method of the washing machine according to an exemplary embodiment of the present invention will hereinafter be described in detail.

If a rinse step is started, the control unit 60 set the number of times to zero. (S1)

And then, the control unit 60 performs a spray rinse step that water is sprayed to the inner tub 6 by the spray nozzle 50 and the inner tub 6 is rotated. (S10) The control unit 60 controls the motor 8 to rotate, and the motor 8 rotates the inner tub 6.

In the spray rinse step S10, a portion of the water which is predetermined to be used is supplied to the inner tub 6 by the spray nozzle 50. (S11) The total amount of water used in the total rinse step may be predetermined according to the amount of the fabrics or the type of the fabrics.

The amount of the water which is sprayed for the each spray rinse step S10 may be set by being divided the total amount of water used for the total rinse step by the performing number of the spray rinse step S10 equally.

For example, in the first exemplary embodiment, the total amount of water used for the total rinse step is about 24 l, the performing number of the spray rinse step S10 is three. Thus, when the spray rinse step S10 is once performed, the amount of the water sprayed may be set to 8 l.

During the spray rinse step S10, the inner tub 6 is constantly rotated with a first rotating speed V1 which is predetermined. (S11) The first rotating speed may be set by a test, etc. The first rotating speed V1 may be predetermined for preventing spattering of the water sprayed by the spray nozzle 50 while the inner tub 6 is rotated. Referring to FIG. 6, the exemplary embodiment of the present invention is described that the first rotating speed V1 is about 25 rpm as an example.

If the inner tub 6 is rotated with the first rotating speed V1, the water sprayed by the spray nozzle 50 can be penetrated into fabrics by centrifugal force. Then, the water penetrated into fabrics can be discharged to the outside of the inner tub 6 through holes of the inner tub 6.

Also, the drain pump 24 is always operated during the spray rinse step (S10). The water discharged into the outside of the inner tub 6 through holes of the inner tub 6 may be discharged into the outside of the washing machine by pumping of the drain pump 24. Because the water rinsed fabrics can be instantly discharged, it can be prevented that fabrics is polluted by the water rinsed fabrics. Therefore, a rinsing performance can be improved.

The spray rinse step S10 may be continued to perform according the predetermined time or the amount of water sprayed. In the exemplary embodiment of the present invention, it is described that the controller 60 may judge whether the predetermined time t1 is passed or not. If the predetermined time t1 is passed, the spray rinse step S10 may be finished. (S14)

If the spray rinse step S10 is finished, the controller 60 performs a spin rinse step S20 that the water supply through the spray nozzle 50 is shut off and the inner tub 6 is rotated at high speed.

During the spin rinse step S20, the water supply through the spray nozzle 50 is shut off. (S21) During the spin rinse step S20, because the inner tub 6 is rotated at high speed faster than a rotating speed of the spray rinse step S10, the water supply through the spray nozzle 50 is shut off. Thus, it is possible to prevent spattering of the water sprayed.

The spin rinse step S20 is performed the acceleration rotation of the inner tub 6 by increasing the rotating speed of the inner tub 6. (S22)

Meanwhile, the drain pump 24 is always operated. (S23)

Namely, during the spin rinse step S20, the water spray is shut off and the inner tub 6 is rotated at high speed by the rotation of the motor 8.

The inner tub 6 is rotated at accelerated speed faster than the first rotating speed V1 so that an effect of water penetration can be improved by the centrifugal force generated by the rotation of the inner tub. The rotating speed of the inner tub 6 during the spin rinse step S20 is faster than the rotating speed of the inner tub 6 during the spray rinse step S10. Thus, the centrifugal force generated from the spin rinse step S20 is larger than that of the spray rinse step S10 so that an effect of water penetration can be improved.

The controller judges whether the predetermined time t2−t1 is passed or not S24, and the spin rinse step S20 is continued until the predetermined time t2−t1 is passed.

The process time t2−t1 of the spin rinse step S20 may be set to be longer than the process time t1 of the spray rinse step S10. This is a quite advantageous condition so as to improve an effect of water penetration.

As described above, a cycle is comprised of one spray rinse step S10 and one spin rinse step S20. The controller 60 may repeat the cycle several times.

When the spin rinse step S20 is finished, the controller 60 counts up the number of cycle times that the spray rinse step S10 and the spin rinse step S20 are performed in order.

The controller 60 repeats the cycle for predetermined the number of times. Namely, the spray rinse step S10 and the spin rinse step S20 are repeated in order for predetermined the number of times.

In the exemplary embodiment of the present invention, it is described that each of the spray rinse step S10 and the spin rinse step S20 is performed three times. If three times of the performance are over, the rinse step is finished. (S25)

Therefore, the present invention is not to spray total water at once but to spray a little water at one time and then performs the spin rinse step rotating the inner tub 6. Therefore, fabrics can be effectively soaked and the water penetration can be improved, and thus the rinsing performances can be improved.

Figure 7:
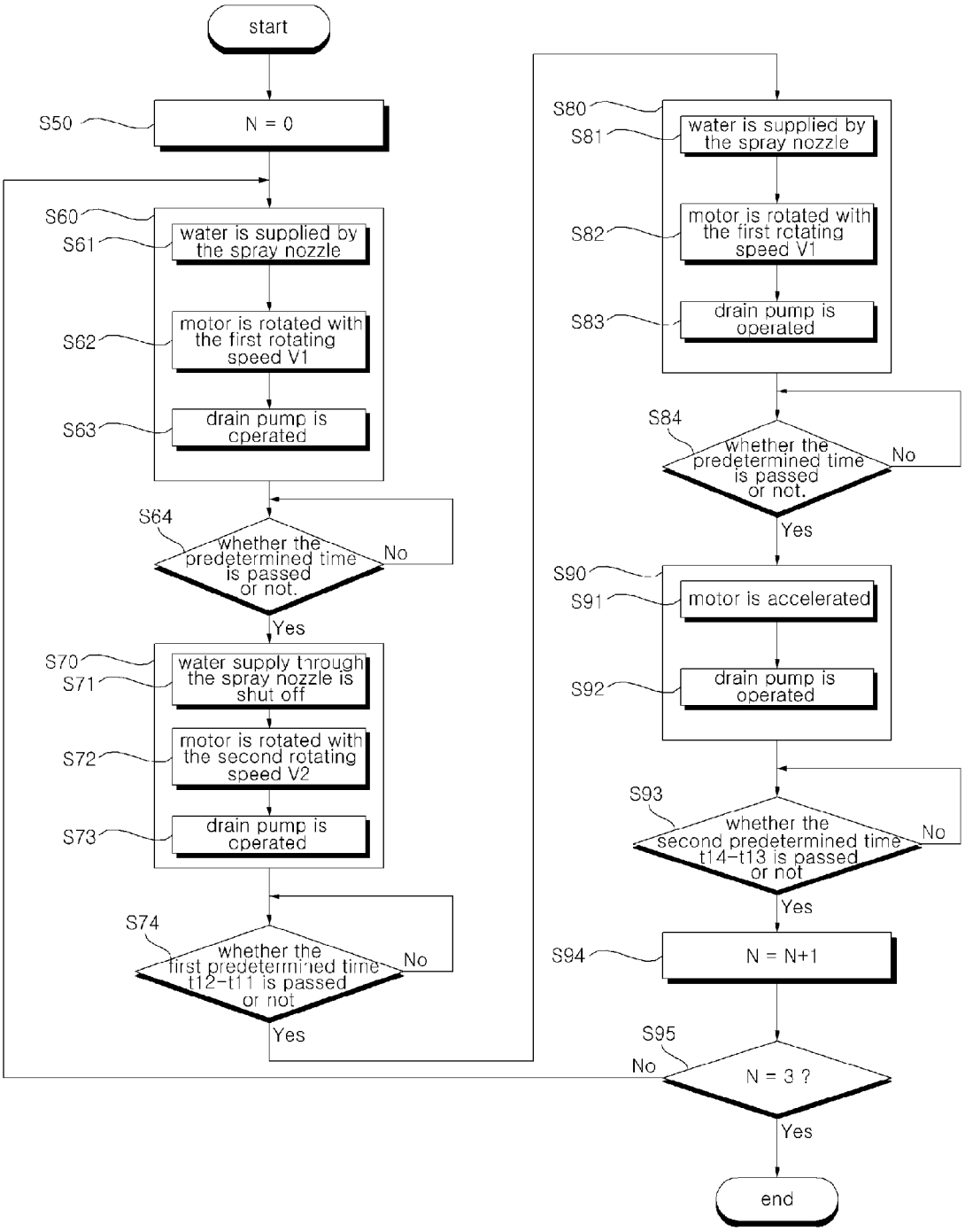
FIG. 7 is a flow chart showing a control method of the washing machine according to a second exemplary embodiment of the present invention.
Figure 8:
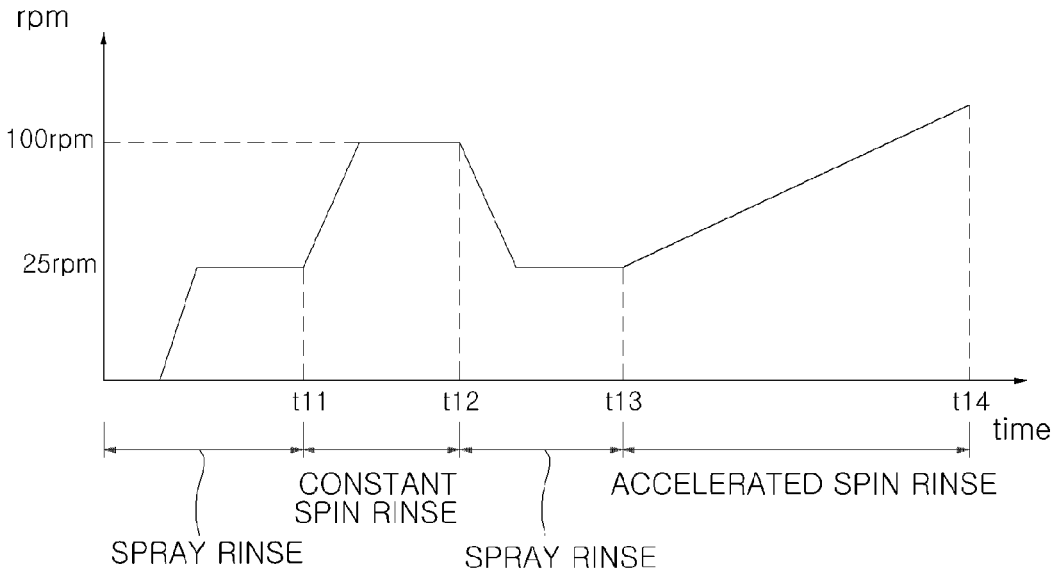
FIG. 8 is a graph showing a rotating speed of an inner tub when a spray rinse step and a spin rinse step is each performed once.

FIG. 7 is a flow chart showing a control method of the washing machine according to a second exemplary embodiment of the present invention. FIG. 8 is a graph showing a rotating speed of an inner tub when a spray rinse step and a spin rinse step is each performed once.

Referring to FIGS. 7 and 8, a control method of the washing machine according to the second exemplary embodiment of the present invention will hereinafter be described in detail.

If a rinse step is started, the control unit 60 set the number of times to zero. (S50)

The control unit 60 performs a first spray rinse step that water is sprayed to the inner tub 6 by the spray nozzle 50 and the inner tub 6 is rotated. (S60)

During the first spray rinse step S60, a portion of the water which is predetermined to be used is supplied to the inner tub 6 by the spray nozzle 50. (S61) The total amount of water used in the total rinse step may be predetermined according to the amount of the fabrics or the type of the fabrics.

The amount of the water which is sprayed for one time of the first spray rinse step S60 may be set by being divided the total amount of water used for the total rinse step by the performing number of the first spray rinse step S60 equally.

For example, in the second exemplary embodiment, the total amount of water used for the total rinse step is about 24 l, each of the first spray rinse step S60 and a second spray rinse step S80 are performed three times. Thus, when the first spray rinse step S60 is once performed, the amount of the water sprayed is set 4 l.

Also, during the first spray rinse step S60, the inner tub 6 is constantly rotated with a first rotating speed V1 which is predetermined. (S61) The first rotating speed V1 may be set by a test, etc. The first rotating speed V1 may be predetermined for preventing spattering of the water sprayed by the spray nozzle 50 when the inner tub 6 is rotated.

Referring to FIG. 8, the exemplary embodiment of the present invention is described that the first rotating speed V1 is about 25 rpm as an example.

The drain pump 24 is always operated during the first spray rinse step S60. The water discharged into the outside of the inner tub 6 through holes of the inner tub 6 may be discharged to the outside of the washing machine by the pumping of the drain pump 24. Because the water rinsed fabrics can be instantly discharged, it can be prevented that fabrics is polluted by water rinsed fabrics. Therefore, a rinsing performance can be improved.

The controller 60 may judge whether the predetermined time t11 is passed or not. (S64) If the predetermined time is passed, the first spray rinse step (S60) is finished.

Thereafter the controller 60 performs a spin rinse step that the water supply through the spray nozzle 50 is shut off and the inner tub 6 is rotated.

The control method according to the second exemplary embodiment of the present invention, the spin rinse step comprises a constant spin rinse step S70 that the inner tub is rotated with the predetermined second rotating speed V2 and an accelerated spin rinse step S90 that the inner tub is accelerated for the predetermined time. The constant spin rinse step S70 and the accelerated spin rinse step S90 will be described later.

The constant spin rinse step S70 may be performed after the first spray rinse step S60.

During the constant spin rinse step S70, the water supply through the spray nozzle 50 is shut off. (S71)

Also, during the constant spin rinse step S70, the inner tub 6 is rotated with the predetermined second rotating speed V2. (S72)

The second rotating speed V2 may be set to be faster than the first rotating speed V1.

The second rotating speed V2 is about 100 rpm as an example in the exemplary embodiment of the present invention. If the inner tub 6 is rapidly rotated with the second rotating speed V2, the water sprayed during the first spray rinse step S60 can be penetrated into fabrics by centrifugal force. Then, the water penetrated into fabrics can be discharged to the outside of the inner tub 7 through holes of the inner tub 6.

The rotating speed of the inner tub 6 during the constant spin rinse step S70 is faster than the rotating speed of the inner tub 6 during the first spray rinse step S60. Thus, the centrifugal force generated during the constant spin rinse step S70 is larger than that of the first spray rinse step S60 so that an effect of water penetration can be improved.

The drain pump 24 is always operated during the constant spray rinse step S70. Because the water rinsed fabrics can be instantly discharged, it can be prevented that fabrics is polluted by water rinsed fabrics. (S73)

The constant spin rinse step S70 is performed for the first set time t12−t11. If the first set time t12−t11 passes S74, the constant spin rinse step S70 is finished.

When the constant spin step S70 is finished, the controller 60 performs the second spray rinse step S80.

The contents of the second spray rinse step S80 is similar to that of the first spray rinse step S60. During the second spray rinse step S80, the water is supplied to the inner tub 6 by the spray nozzle 50, and the inner tub 6 is rotated with the first rotating speed V1, and the drain pump 24 is operated. S83

The amount of the water sprayed in the second spray rinse step S80 is equal that of the first spray rinse step S60. Namely, the amount of the water sprayed is 4 l.

The second spray rinse step S80 is performed for the predetermined time t13−t12. If the predetermined time t13−t12 is passed, the second spray rinse step S80 is finished.

If the second spray rinse step S80 is finished, the controller 60 performs the accelerated spin rinse step S90.

During the accelerated spin rinse step S90, the rotating speed of the inner tub 6 is accelerated for the second set time t14−t13. (S91) Meanwhile, the drain pump is maintained to be operated. (S92)

The accelerated spin rinse step S90 is performed for the second set time t14−t13. The controller 60 judge whether the second set time t14−t13 passes or not. (S93)

During the accelerated spin rinse step S90, the inner tub 6 is accelerated by the acceleration of the motor 8. Thus, the water sprayed during the second spray rinse step S80 can be penetrated into fabrics by the centrifugal force.

The accelerated spin rinse step S90 may be performed that the inner tub 6 is accelerated to be faster than the second rotating speed V2 of the constant spin rinse step S70.

The process time t14−t13 of the accelerated spin rinse step S90 is set to be longer than the process time t12−t11 of the constant spin rinse step S70.

Namely, the accelerated spin rinse step S90 may be performed that the inner tub 6 is accelerated faster and longer than the constant spin rinse step S70.

A cycle is comprised that the first spray rinse step S60, the constant spin rinse step S70, the second spray rinse step S80 and the accelerated spin rinse step S90 are once performed in order.

The controller 60 may perform the cycle several times.

The controller 60 counts up the number of cycle times which the first spray rinse step S60, the constant spin rinse step S70, the second spray rinse step S80 and the accelerated spin rinse step S90 are performed in order. (S94)

The controller 60 repeats the cycle for predetermined number of times.

In the exemplary embodiment of the present invention, it is described that the cycle is performed three times. Namely, if the first spray rinse step S60, the constant spin rinse step S70, the second spray rinse step S80, the accelerated spin rinse step S90 are performed in order for three times, the rinse step is finished. (S95)

Therefore, the present invention is not to spray total water at once but to spray a little water at one time, and then performs the spin rinse step rotating the inner tub 6. Therefore, fabric can be effectively soaked and the water penetration can be improved, and thus rinsing performances can be improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A control method of a laundry machine comprising:

a first spray rinse step that water is sprayed by a spray nozzle and an inner tub is rotated at a first rotating speed for a first predetermined time;

a constant spin rinse step that the water supply through the spray nozzle is shut off and the inner tub is accelerated to a second rotating speed which is faster than the first rotating speed and then is rotated at the second rotating speed for a second predetermined time;

a second spray rinse step that the water is sprayed by the spray nozzle and the inner tub is rotated at a third rotating speed for a third predetermined time; and an accelerated spin rinse step that the water supply through the spray nozzle is shut off and the inner tub is accelerated from the third rotating speed to a fourth rotating speed which is faster than the second rotating speed for a fourth predetermined time which is longer than the second predetermined time, wherein a section of a constant rotating speed is not included in the accelerated spin rinse step, wherein a cycle is comprised of the first spray rinse step, the constant spin rinse step, the second spray rinse step and the accelerated spin rinse step, and wherein the cycle is repeated for a predetermined number of times.

2. The control method of a laundry treatment machine of claim 1, wherein an amount of water which is sprayed in the first spray rinse step is equal to an amount of water which is spray in the second spray rinse step.

3. The control method of a laundry treatment machine of claim 1, wherein the drain pump is always operated for a plurality of the cycles.

4. The control method of a laundry treatment machine of claim 1, wherein the third rotating speed is equal to the first rotating speed, and the third predetermined time is equal to the first predetermined time.

5. The control method of a laundry treatment machine of claim 1, wherein a total amount of water sprayed during the rinsing operation is determined according to an amount and/or a type of fabrics to be rinsed and then the portion of water sprayed during each spray rinse step is set by dividing the total amount of water sprayed by the predetermined number of times of the spray rinse steps.

6. The control method of a laundry treatment machine of claim 1, wherein the drain pump is always operated in the spray rinse step, the constant spin rinse step and the accelerated spin rinse step.

7. The control method of a laundry treatment machine of claim 1, wherein, during the entire accelerated spin rinse step, the inner tub is not rotated at a constant rotating speed.

* * * * *